United States Patent [19]

Singer et al.

[11] Patent Number: 4,463,529

[45] Date of Patent: Aug. 7, 1984

[54] COMBINED LANDSCAPING AND FOUNDATION WALL PROTECTIVE ARTICLE

[76] Inventors: Ronald E. Singer, 2060 Fenton, Edgewater, Colo. 80214; Raymond A. Stewart, 12099 E. Louisiana, Aurora, Colo. 80012

[21] Appl. No.: 473,725

[22] Filed: Mar. 9, 1983

[51] Int. Cl.[3] ..... E02B 11/00; E02D 5/00; E02D 19/00

[52] U.S. Cl. ..... 52/169.5; 52/102; 52/742; 52/169.14; 405/43; 405/229; 47/33

[58] Field of Search ..... 52/169.5, 169.11, 169.12, 52/169.14, 16, 102, 302, 742, 58, 59, 60, 61; 405/36, 43, 45, 229; 47/32, 33

[56] References Cited

U.S. PATENT DOCUMENTS

| | | | |
|---|---|---|---|
| 2,050,798 | 8/1936 | Kothe | 52/62 |
| 2,899,771 | 8/1959 | Burris, Jr. | 52/169.14 |
| 3,515,373 | 6/1970 | Abbe | 52/102 |
| 3,545,127 | 12/1970 | Jensen | 47/33 |
| 3,850,193 | 11/1974 | Guzzo | 52/169.5 |

FOREIGN PATENT DOCUMENTS

| | | | |
|---|---|---|---|
| 673410 | 11/1963 | Canada | 52/102 |
| 1418725 | 12/1975 | United Kingdom | 52/169.14 |

*Primary Examiner*—John E. Murtagh
*Assistant Examiner*—Andrew J. Rudy
*Attorney, Agent, or Firm*—Donald W. Margolis

[57] ABSTRACT

Articles are disclosed for use in providing both waterproofing protection to a foundation wall, and a support system for decorative landscaping material around the perimeter of a building. The article is in the form of an open pan having a waterproof and substantially impervious bottom, a continuous back-wall; a front-wall including perforations, and a pair of side-walls. The pan is used by placing it adjacent to a foundation wall at ground level with its back-wall abutting the foundation wall, its bottom on the ground at grade level, and its perforated front-wall spaced from the foundation wall. Additional pans may be placed adjacent to the pan at one or both of its side-walls. When so placed a plurality of pan articles of the present invention provide a continuous water impermeable carrier along a foundation wall which prevent water or other liquids from entering the ground immediately adjacent the foundation, while allowing such liquids to be drained from the pan at a controlled rate and at a distance from the foundation wall through the perforations in the front-wall. Additionally, the pan provides a barrier or mulch to prevent the growth of unwanted weeds or other plants around the foundation, while also providing stable boundaries for decorative material such as rock, bark or the like. In one preferred embodiment, opposed side-walls of the same pan are respectively a U-shaped groove, and a substantially upright tongue, thus allowing easy, but substantially waterproof groove and tongue joinder of adjacent pans.

20 Claims, 4 Drawing Figures

COMBINED LANDSCAPING AND FOUNDATION WALL PROTECTIVE ARTICLE

BACKGROUND OF THE INVENTION

1. Field of the Invention

The present invention relates to an article for earth engineering to provide drainage control adjacent to the foundation wall of a static structure, such as a building. The same article also provides a container for decorative landscaping material and a mulch for the prevention of unwanted plant growth.

2. Discussion of the Prior Art

In the past many techniques have been utilized to provide protection for foundation walls from water and water seepage. The most common techniques include the expendients of coating the external surfaces of the foundation walls with a waterproofing or water inhibiting coating prior to backfilling with dirt around the foundation. Other common and inexpensive techniques include the placement of drainage tile around the foundation walls prior to backfilling. U.S. Pat. No. 2,050,798 (Korthe) discloses the use of a protective layer in the form of a smooth waterproof membrane attached to the foundation wall, preferably above grade level, and then laid into an excavation around the wall at a downward angle away from the wall, followed by the replacement of soil upon the membrane. This form of protection inherently results in water flowing downward over the membrane so that it is carried down into the soil around the foundation where, as water will always do, it seeks its own level. When seeking its own level the possibility exists for the water to easily percolate under the membrane and then rise between the membrane and the foundation wall, thus allowing it to seep into contact with and through the foundation wall.

It has also been known in the prior art to place protective sheets in the ground, vertically against foundation walls; such sheets including dimples, studs or other protrusions to provide air circulation between the sheets and the foundation wall to encourage drainage away from the walls, to provide insulation to the wall, and to facilitate drying of the foundation walls after they have become wet, for example as taught in U.S. Pat. No. 3,888,087 (Bergsland). This form of protection does little to keep drainage water from being adjacent to or contacting the foundation wall.

It is also common practice to place a gutter or splash block on the ground below a down spout in order to prevent roof drainage water from eroding the soil and draining into the ground at the foundation wall. Such splash blocks are normally isolated, and in the form of a channel walled on three sides and completely open at the end placed furthest from the building structure. Such splash blocks are normally quite heavy, for example being made from concrete, and weighing 12 pounds per square foot, or more, and are therefore difficult for one person to place or move.

Various mulches have been used to control water seepage, water evaporation, weed growth, and as underlayers for decorative landscaping materials. These mulches include a wide variety of materials, ranging from plant material, to flat boards, and flexible sheet material such as tar paper and flexible plastic. Such mulches have been used at grade level around buildings, and when intact can prevent water seepage at a foundation wall. However, most of these mulches are useful for perhaps only one or two seasons at the best, as they are subject to deterioration, mechanical shifting, puncturing and other problems which limit their useful life. For example, where a sheet of tar paper or a film of plastic, typically 0.5 to 6.0 mils. (0.013 to 0.15 mm) thick, is used as a mulch and covered with, for example, decorative rock, almost any pressure transmitted to the surface of the film will cause the sheet to be punctured. A multiplicity of punctures in the film eventually results in the rapid loss of utility of such a sheet as a mulch or waterproofing article.

It is therefore seen that while there are many prior art articles and methods for avoiding the seepage of water around foundation walls, and for providing mulching and support for decorative materials, there is no known technique or article which is placed at grade level around a foundation wall, is lightweight, mechanically and physically stable and which is substantially impervious to being punctured or broken in usage.

SUMMARY OF THE INVENTION

The present invention provides an article which can be utilized at a foundation wall to provide waterproofing protection for a foundation wall, as a support for decorative landscaping material, and as a mulch to prevent unwanted weed or plant growth along a foundation. The article is in the form of a pan placed at grade level adjacent to a foundation wall. The pan has a substantially continuous flat bottom of waterproof, substantially impervious, puncture resistant material. An upright back-wall and a pair of side-walls are substantially continuously connected to the side-edges of the bottom of the pan. A front-wall is provided in the vicinity of the front edge of the bottom of the pan. The front-wall has drainage openings through it to allow moisture collected in the pan to drain from the pan at a controlled rate at a distance from the foundation.

In use, the pan is placed on the ground at grade level with its back-wall adjacent to the to-be-protected foundation wall and its front-wall spaced from the foundation. Normally a plurality of such pans are utilized, side-by-side to totally protect the entire, or a selected portion of the, foundation. In preferred usage the back-walls of the pans are mechanically secured to the foundation and the adjacent side-walls of adjacent pans are also mechanically connected together by fastening devices or by overlapping. Subsequently, decorative landscaping material may be placed in each pan. Each pan also serves as a mulch to prevent the growth of weeds or other unwanted plants around the foundation.

The total pan is preferably of such a size and weight that a single workperson can easily lift and place it in its desired location. However, the bottom of the pan is of material selected to withstand puncturing pressures of at least two hundred pounds per square inch. The weight of the pan is no more than about one pound per square foot, preferably much less.

These and other objects of the present invention will become apparent to those skilled in the art from the following detailed description, showing the novel construction, combination, and arrangement of parts as herein described, and more particularly defined by the appended claims, it being understood that such changes in the precise embodiments of the herein disclosed invention are meant to be included as come within the scope of the claims except insofar as precluded by the prior art.

BRIEF DESCRIPTION OF THE DRAWINGS

The accompanying drawings illustrate complete preferred embodiments of the present invention according to the best mode presently devised for the practical application of the principles thereof, and in which:

Referring now to FIGS. 1 and 2 in detail, reference character 2 is used to designate generally a pan in accordance with the present invention of suitable material and desired dimensions, as detailed hereinafter. Pan 2 is placed at grade on ground 4 (shown in cross-section) and abutting foundation wall 6 (shown in cross-section). In preferred embodiments pan 2 is normally rectangular or square and includes a substantially continuous, flat, puncture resistant, substantially waterproof and impervious bottom 12 and upright back-wall 14 in substantially continuously sealed connection to bottom 12 at its back-edge. Also substantially continuously sealed to bottom 12 at its sides are side-walls 16 and 18. Completing the pan enclosure is front-wall 22 which serves as a drainage control barrier. Front-wall 22 includes a plurality of lower drainage ports 24 and may also include a plurality of other drainage openings 26. In the preferred embodiment shown drainage lip 28, which may be an extention of bottom 12, extends outwardly beyond front wall 22.

Figure 1:
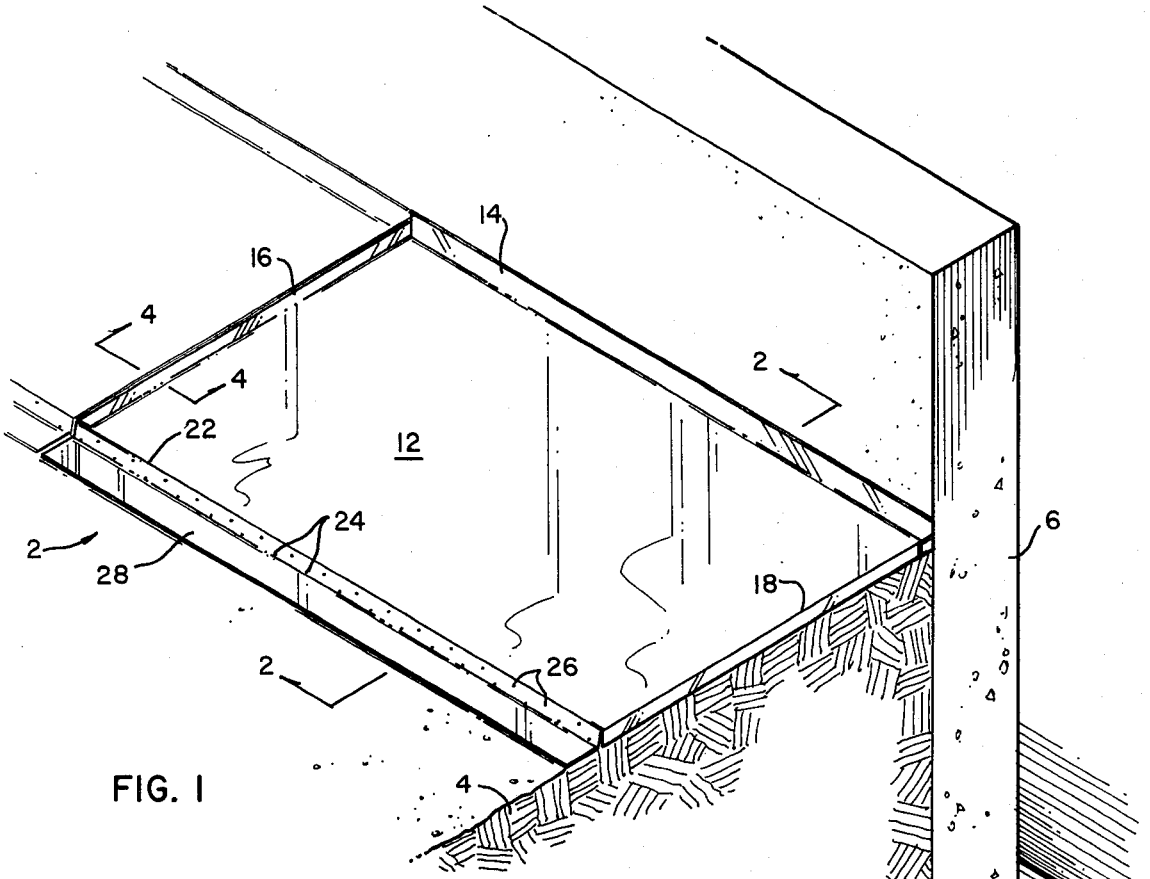
FIG. 1 is a perspective view of a pan constructed in accordance with the present invention placed at grade against a foundation wall and on the ground, shown in cross-section.

In preferred embodiments pan 2 will normally be of one or more standard modular widths between side-walls 16 and 18, say 4 feet (1.22 m.), 8 feet (2.44 m.) or 12 feet (3.66 m.). It will also preferably be of standard modular lengths between the back-wall and the front-wall, say 15 inches (38 cm.), 30 inches (76 cm.) or 45 inches (114 cm.).

Figure 3:
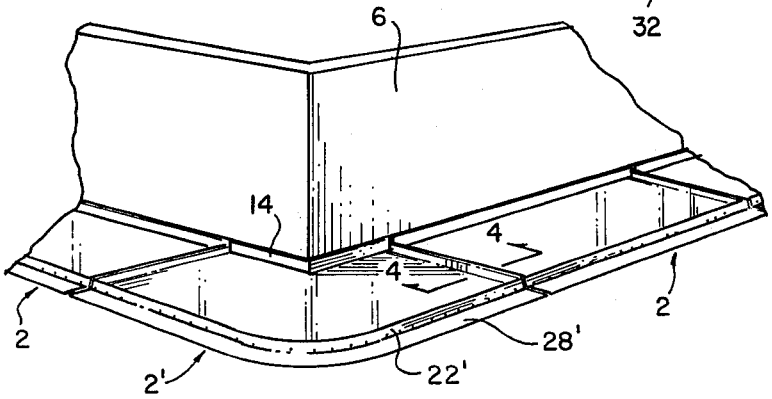
FIG. 3 is a perspective view of a plurality of pans of the present invention arrayed at grade around a foundation wall, and including a modified form of the pan of the present invention for use at a corner.

Referring now to FIG. 3, a plurality of pans 2 are shown arrayed in side-by-side abutting relationship at grade level around foundation walls 6 of a static structure, such as a building. Each pan 2 is placed with its back-wall 14 adjacent to and in contact with foundation wall 6 and is preferably secured to wall 6 by suitable mechanical means such as ram-set nails or studs (not shown) hammered through washers (not shown) and back-wall 14 into foundation wall 6. As additional bonding, securing and waterproofing, the space of any crevices between foundation wall 6 and pan back-wall 14 may be suitably sealed with caulking material. Caulking this is by no means essential since the small amount of water which could enter between foundation wall 6 and pan back-wall 14 would hardly do much harm, especially in view of the fact that many buildings have overhanging roofs above this area. In preferred usage the grade around the wall is prepared so that each pan 2 is either level or sloped slightly downward away from foundation wall 6.

Still referring to FIG. 3, where pans 2 of the present invention are arrayed around more than one side of a structure, a corner pan of the type represented by 2' will be required to make the transition from one wall to the next. In such a corner pan 2' the back-wall 14' would be angled to fit the corner of the structure and its front edge 28' and front-wall wall 22' would be, for example, curved. Normally the curve of front-wall 22' and front edge 28' would most simply be that of a circle or ellipse having the same radius or compound radii as the length of adjacent pans 2.

Figure 4:
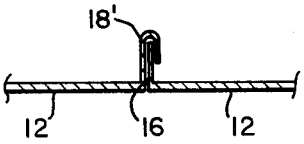
FIG. 4 is an enlarged cross-sectional view of one form of preferred connection between the side-walls of two adjacent pans, taken, for example, along lines 4—4 of FIG. 3.

Joinder between the side-walls 16 and 18 of adjacent pans 2, or between 2 and 2', may be by any number of mechanical devices, not shown, such as bolts, brackets, clamps and so on. However, in one preferred embodiment shown in enlarged detail in FIG. 4, side-wall 16 may be in the form of tongue 16' and side-wall 18 may be in the form of groove 18'. This alternate form of tongue and groove side-walls would allow for immediate and easy waterproof joinder between adjacent pans without the need for additional mechanical devices or special steps or procedures.

Once the desired array of pans 2 and/or 2' are located around the foundation walls 6 of the structure and secured, as desired, to walls 6 and to one another, pans 2 and/or 2' can be, and normally will be, filled with decorative material such as rock, lava, bark or the like. The pan itself may be colored in a variety of ways for decorative purposes.

In use, water coming into pans 2, and/or 2' from above, whether from rainfall, watering, flowing surface water, or from any other source will enter the top open surface of pans 2 or 2' where, due to the water impermeable nature of the pan's bottom, it will be kept from penetrating into the ground below the pans adjacent foundation walls 6. Pans 2 and 2' also serve to retain decorative material in place around foundation walls 6 and as a mulch to prevent the growth of unwanted weeds or plants. Where pans 2 abut a grass or lawn area lip 28 makes mowing and trimming adjacent the pans quite easy. Lip 28 also serves to limit ground erosion due to water flowing through drainage ports 24 and openings 26.

Figure 2:
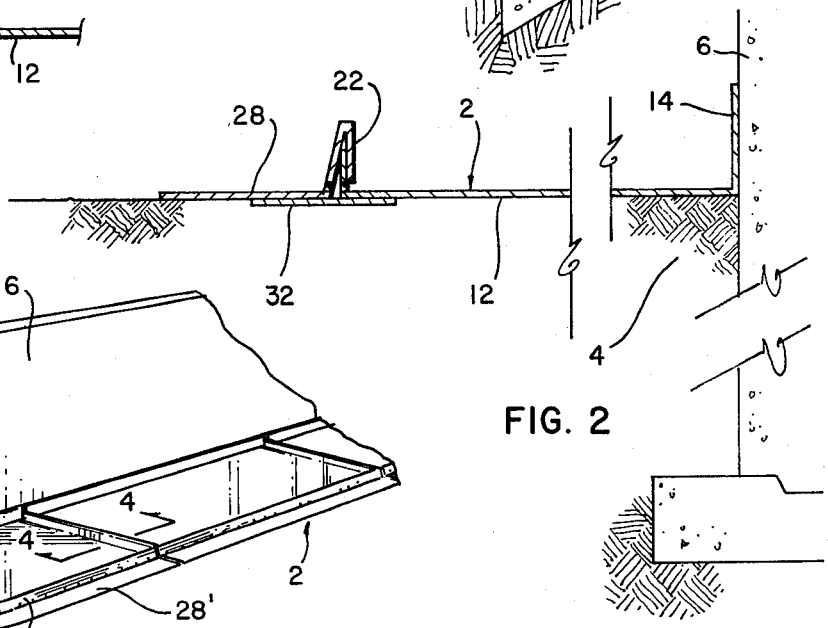
FIG. 2 is a transverse cross-sectional view of the pan of FIG. 1 taken along lines 2—2.

Pans 2 and 2' may be most simply and economically formed from sheets of stock material, such as light weight 10 to 20 mil thick plastic, with simple cutting tools and a small amount of cutting, bending and connecting. Front-wall 22 may be formed as a doublefold, as shown in FIG. 2, with a strip 32 beneath it. Strip 22 holds the fold together, keeps water which passes through perforation 24 and 26 from sinking into the ground and undercutting the pan in this area, and prevents the growth of plant materials in the groove formed by the fold. Plastic material of this kind and thickness is capable of being subjected to pressures of two hundred pounds per square inch and more without being punctured or ruptured. Preferred materials are of a thermoplastic or thermosetting nature, and may be homogeneous or include strengthing fibers, such as fiberglass. Other materials which are suitable for the practice of the present invention are sheet tin, aluminum, their alloys and other light metals; treated wood or plywood. Thick tar paper, press board, composition board and other waterproof, puncture resistant, lightweight materials may also be used in the practice of the present invention. In its preferred embodiments the pan systems of the present invention will have a weight of no more than about 1 pound per square foot, and preferably less, or a total of 30 pounds or less per pan unit 2 or 2'.

While preferred embodiments of the pan are unitary, in modified forms the pan may be scored in various ways for easy breakdown and reassembly of unusual lengths or of special or finishing widths.

As used in the present application the term "back-wall" is intended to encompass and be equivalent to any back member of a pan which is shaped, curved or angled in any way to abut a foundation wall. Similiarly, while "side-walls" will normally be straight, any configuration of side-walls which allows side-by-side abuttment between adjacent pans, or a special configuration of a side-wall at the end of an array of pans is included and equivalent to the term "sidewall" as used herein. It has already been shown, and it is intended, that the term "front-wall" have a similiar liberal interpretation as to equivalents.

Drainage holes 24 in front-wall 22 are preferably at the lowest level of front-wall 22, that is where front-wall 22 joins bottom 12, to thus allow substantially complete drainage of liquids from pan 2. By controlling the number and size of drainage holes 24 the rate of flow of liquids from pan 2 is controlled. In preferred embodiments the number and size of holes 24 is controlled and selected to allow drainage from pan 2 at a rate which would neither cause erosion in front of the pan nor a rapid buildup of water in the pan or in the ground at the front edge of the pan, which buildup might encourage substantial seepage under the pan and back towards foundation wall 6.

It would be possible, within the teaching of the present invention, to selectively form or cut planter or other holes in bottom 12, and still obtain the major benefits of the present invention.

It is thus seen that the present invention provides an article which prevents the seepage of water into the ground around foundation walls, which provides mulching to prevent unwanted plant growth, which provides support and stability to decorative materials, and which is lightweight, stable and is substantially impervious to being broken or punctured in ordinary usage.

Additional embodiments of the present invention will be apparent to those skilled in the art. It is therefore intended that the scope of the invention be limited only by the appended claims and the prior art and not by the preferred embodiments described herein. Accordingly, reference should be made to the following claims in determing the full scope of the present invention.

What is claimed is:

1. A pan for the protection of the ground adjacent a foundation wall including, in combination:

a bottom, said bottom having a back-edge, a front-edge and at least one side-edge, said bottom being composed of puncture resistant liquid impermeable initially imperforate material;

a back-wall, said back-wall rising from and substantially continuously connected to said bottom along said back-edge of said bottom;

at least one side-wall, each said side-wall rising from and substantially continuously connected to said bottom along each side-edge of said bottom; and a front-wall, said front-wall spaced from said back-wall and connected to and rising from said bottom at a location at or in the vicinity of said front-edge of said bottom, said front-wall defining a plurality of liquid drainage openings therethrough; whereby said bottom, said back-wall, said side-wall and said front-wall define a pan, which pan substantially prevents liquid which enters said pan from above from penetrating into the ground below said pan adjacent such portion of a foundation wall along which said pan has been placed with its back wall juxtaposed to the foundation wall, said pan allowing any such liquid to drain from said pan through said drainage openings at a controlled flow rate at a distance from said foundation wall.

2. The pan of claim 1 wherein at least some of said drainage openings in said front-wall are located at the portion of said front-wall adjacent said bottom.

3. The pan of claim 1 including a bottom lip, wherein said lip is adjacent to said front-wall and extends away from said front-wall.

4. The pan of claim 1 wherein said front-wall is spaced from said front-edge of said bottom to define a lip extending away from said front-wall.

5. The pan of claim 1 wherein at least the bottom of said pan is composed of light weight material having a weight of about one pound, or less, per square foot of bottom area.

6. The pan of claim 1 wherein the total weight of said pan is thirty pounds, or less.

7. The pan of claim 1 wherein said puncture resistant bottom is composed of light weight material capable of resisting puncturing at pressures of at least two hundred pounds per square inch selected from the group of materials consisting of plastic, light weight metal, wood based products, and paper based products.

8. The pan of claim 7 wherein said light weight puncture resistant plastic material is selected from the group consisting of thermoplastic plastic, thermoset plastic and fiberglass reinforced plastic material.

9. The pan of claim 8 wherein said plastic material has a thickness of from about 10 mils to about 20 mils.

10. The pan of claim 7 wherein said light weight puncture resistant metal material is selected from the group consisting of tin, aluminum, alloys of tin, and alloys of aluminum.

11. The pan of claim 7 wherein said light weight puncture resistant wood based material is selected from the group consisting of treated wood, plywood, press board and composition board.

12. The pan of claim 1 wherein said pan has two opposed side-walls and the width of said pan between said side-walls is in the range of from about 4 feet to about 12 feet wide, and the length of said pan between said back-wall and said front-wall is in the range of from about 15 inches to about 45 inches long.

13. A structure including a plurality of pans of the type set forth in claim 1, wherein two or more such pans are placed in side-wall adjacent relation to one another with their back-walls adjacent a foundation wall.

14. The structure of claim 13 wherein each side-wall of each said pan is mechanically connected to the adjacent side-wall of the next side adjacent pan.

15. The structure of claim 14 wherein said side-wall of one pan is in the form of a groove, and wherein said adjacent side-wall of the next side adjacent pan is in the form of a tongue, whereby said adjacent pans are mechanically connected at such side-walls in overlapped tongue and groove relationship.

16. A structure including a plurality of pans in side adjacent relation to one another for the protection of the ground adjacent a foundation wall each pan including, in combination:

a bottom, said bottom having a back edge, a front-edge and at least one side-edge, said bottom being composed of puncture resistant liquid impermeable initially imperforate material;

a back-wall, said back-wall rising from and substantially continuously connected to said bottom along said back-edge of said bottom;

at least one side-wall, each said side-wall rising from and substantially continuously connected to said bottom along each side-edge of said bottom; and a front-wall, said front-wall spaced from said back-wall and connected to and rising from said bottom at a location at or in the vicinity of said front-edge of said bottom, said front-wall defining a plurality of liquid drainage openings therethrough; whereby said bottom, back-wall, side-wall and front-wall define a pan which pan substantially prevents liquid which enters said pan from above from penetrating into the ground below said pan adjacent such portion of a foundation wall along which said plurality of pans have been placed with their back-walls juxtaposed to the foundation wall, said pan allowing any such liquid to drain from said pan through said drainage openings at a controlled flow rate at a distance from said foundation wall.

17. The structure of claim 16 wherein each said pan is mechanically connected to the adjacent side-wall of the next side adjacent pan.

18. The structure of claim 17 wherein said side-wall of one pan is in the form of a groove and wherein said adjacent side wall of the next side adjacent pan is in the form of a tongue, whereby said adjacent pans are mechanically connected at such side-walls in overlapped tongue and groove relationship.

19. A method of providing a drainage control structure adjacent the foundation of a static structure including the step of:

placing one or more pans adjacent a foundation wall wherein each said pan includes, in combination a bottom, said bottom having a back-edge, a front-edge and at least one side-edge, said bottom being composed of puncture resistant liquid impermeable initially imperforate material; a back-wall, said back-wall rising from and substantially continuously connected in substantially liquid impermeable joinder to said bottom along said back-edge of said bottom; at least one side-wall, each said side-wall rising from and substantially continuously connected to each side-edge of said bottom; and a front-wall, said front-wall spaced from said back-wall and connected to and rising from said bottom at a location at or in the vicinity of said front-edge of said bottom, said front-wall defining a plurality of liquid drainage openings therethrough; whereby said bottom, back-wall, side-wall and front-wall define said pan which pan substantially prevents liquid which enters said pan from above from penetrating into the ground below said pan adjacent such portions of such foundation wall along which said pan has been placed with its back-wall juxtaposed to said foundation wall, each said pan allowing any such liquid to drain from said pan through said drainage openings at a controlled flow rate at a distance from said foundation wall.

20. The method of claim 19 wherein a plurality of pans are placed in side-wall adjacent relation to one another along said foundation wall and mechanically connected to the adjacent side-wall of the next adjacent pan.

* * * * *